US012253320B1

(12) United States Patent
Ahn et al.

(10) Patent No.: US 12,253,320 B1
(45) Date of Patent: Mar. 18, 2025

(54) LASER DIODE PRIMER AND CANNON IGNITING PROPELLING CHARGES WITH ELECTRICAL SIGNAL USING THE SAME

(71) Applicant: AGENCY FOR DEFENSE DEVELOPMENT, Daejeon (KR)

(72) Inventors: Sangtae Ahn, Daejeon (KR); Yongseon Lee, Daejeon (KR); Yunjung Oh, Daejeon (KR)

(73) Assignee: AGENCY FOR DEFENSE DEVELOPMENT, Daejeon (KR)

( * ) Notice: Subject to any disclaimer, the term of this patent is extended or adjusted under 35 U.S.C. 154(b) by 0 days.

(21) Appl. No.: 18/941,941

(22) Filed: Nov. 8, 2024

(30) Foreign Application Priority Data

Jun. 26, 2024 (KR) ..... 10-2024-0083470

(51) Int. Cl.

| | |
|---|---|
| ***F41A 19/58*** | (2006.01) |
| ***F41A 3/10*** | (2006.01) |
| ***F41A 19/57*** | (2006.01) |
| ***F41F 1/00*** | (2006.01) |

(52) U.S. Cl.
CPC ..... *F41A 19/58* (2013.01); *F41A 3/10* (2013.01); *F41A 19/57* (2013.01); *F41F 1/00* (2013.01)

(58) Field of Classification Search
CPC .. F41A 3/10; F41A 19/57; F41A 19/58; F41A 19/70
USPC ..... 42/14; 89/27.11, 28.05, 28.1, 28.2
See application file for complete search history.

(56) References Cited

U.S. PATENT DOCUMENTS

| | | | | |
|---|---|---|---|---|
| 270,590 | A * | 1/1883 | Hotchkiss | F41A 3/10 89/24 |
| 3,685,392 | A * | 8/1972 | Platt | F41A 19/58 42/76.01 |
| 3,748,770 | A * | 7/1973 | Mitchell | F41A 19/58 42/84 |
| 4,329,908 | A * | 5/1982 | Rowlands | F41A 19/70 89/27.11 |
| 4,341,031 | A * | 7/1982 | Palmer | F41A 3/10 42/23 |

(Continued)

FOREIGN PATENT DOCUMENTS

| | | | |
|---|---|---|---|
| JP | 2017211118 | A | 11/2017 |
| JP | 2020051687 | A | 4/2020 |

(Continued)

*Primary Examiner* — Bret Hayes
(74) *Attorney, Agent, or Firm* — Osha Bergman Watanabe & Burton LLP

(57) ABSTRACT

A cannon includes: a barrel; a breech ring connected to the rear of the barrel; a breechblock connected to be movable with respect to the breech ring between a closed position and an open position; an ignition device mounted to be partially movable with respect to the breechblock and configured to ignite a propelling charge; and a controller configured to transfer an electrical firing signal, wherein the ignition device includes: a firing assembly moving forward and backward as the breechblock moves; a laser diode primer connected to the front of the firing assembly and configured to receive the electrical firing signal to ignite the propelling charge; and a firing pin connected to be movable forward and backward with respect to the firing assembly and configured to transfer the electrical firing signal to the laser diode primer while in contact with a rear end of the laser diode primer.

8 Claims, 9 Drawing Sheets

(56) References Cited

U.S. PATENT DOCUMENTS

| | | | | |
|---|---|---|---|---|
| 5,206,455 | A * | 4/1993 | Williams | F42C 21/00 102/201 |
| 5,485,786 | A | 1/1996 | Hesse et al. | |
| 6,499,404 | B1 * | 12/2002 | Kern | F42B 3/113 102/201 |
| 7,546,804 | B1 | 6/2009 | Tartarilla, III et al. | |
| 2003/0047101 | A1 * | 3/2003 | Folsom | F42B 3/113 102/201 |

FOREIGN PATENT DOCUMENTS

| | | | |
|---|---|---|---|
| KR | 20130050645 | A | 5/2013 |
| KR | 101280863 | B1 | 7/2013 |
| KR | 102164993 | B1 | 10/2020 |

* cited by examiner

LASER DIODE PRIMER AND CANNON IGNITING PROPELLING CHARGES WITH ELECTRICAL SIGNAL USING THE SAME

CROSS-REFERENCE TO RELATED APPLICATIONS

This application claims priority under 35 USC § 119 (a) to Korean Patent Application No. 10-2024-0083470 filed on Jun. 26, 2024, in the Korean Intellectual Property Office, the disclosure of which is incorporated by reference herein in its entirety.

BACKGROUND

1. Field

The following description relates to a laser diode primer and a cannon igniting a propelling charge with an electrical firing signal using the laser diode primer.

2. Description of Related Art

In general, a cannon ignites a propelling charge and fires a shell using the pressure of the ignited propelling charge. A typical method of percussing a primer to ignite the propelling charge may require extraction and resupply of the primer, which may consume human labor and costs and may cause the propelling charge to misfire or fire at an unintended time. A laser ignition method, which may replace a typical firing method, has been proposed to automate the operation of the cannon and reduce the costs. However, it still has a disadvantage in that an ignition delay time of the propelling charge increases compared to the typical firing method.

The above description is information the inventor(s) acquired in the course of conceiving the present disclosure, or already possessed at the time, and is not necessarily art publicly known before the present application was filed.

SUMMARY

An object of the present disclosure is to provide a cannon that ignites a propelling charge using a laser diode primer.

An object of the present disclosure is to provide a cannon with a reduced ignition delay time compared to a typical laser ignition method.

According to an embodiment, there is provided a cannon including: a barrel having a chamber formed therein in which a shell and a propelling charge are mounted; a breech ring connected to the rear of the barrel, and having a shell inlet communicating with the chamber; a breechblock connected to the breech ring to be movable upward and downward with respect to the breech ring between a closed position that closes the shell inlet and an open position that opens the shell inlet, and having a primer flame hole communicating with the chamber at the closed position; an ignition device mounted to be partially movable with respect to the breechblock and configured to ignite the propelling charge mounted in the chamber through the primer flame hole; and a controller configured to transfer an electrical firing signal to the ignition device. The ignition device may include: a firing assembly configured to move forward and backward as the breechblock moves; a laser diode primer including a case and gunpowder disposed inside the case, connected to the front of the firing assembly and contacting the rear of the primer flame hole at the closed position, and configured to receive the electrical firing signal to ignite the propelling charge through the primer flame hole; and a firing pin connected to the firing assembly to be movable forward and backward with respect to the firing assembly and configured to transfer the electrical firing signal to the laser diode primer while in contact with a rear end of the laser diode primer.

The firing assembly may include: a support member; a first housing disposed on the support member and including a first opening that is open forward; a second housing disposed within the first housing, movable forward and backward inside the first housing, and including a second opening that is open forward; and a lever member configured to press the second housing forward through a rotation. The firing pin may be installed in the second housing such that a front end thereof passes through the first opening.

The firing assembly may further include a first spring installed in the first housing and configured to restore a position of the second housing.

The firing pin may be positioned inside the first housing when no external force is applied, and the front end may protrude to the front of the first housing when the second housing is pressed forward by the lever member.

The firing pin may come into contact with the rear end of the laser diode primer by a rotation of the lever member when the breechblock is at the closed position.

The firing assembly may further include a second spring installed in the second housing and connected to a rear end of the firing pin. The second spring may be compressed when the second housing is pressed forward, and apply a restoring force to the firing pin such that at least a portion of the firing pin is positioned on the first opening when no external force is applied to the second housing.

The breech ring may further include a cam plate having a guiding groove formed therein, the support member may further include a follower movably connected to the guiding groove, and the breechblock may further include a pushrod selectively contacting the lever member. While the breechblock is moving from the open position to the closed position, the firing assembly may move forward by a movement of the follower, and the lever member may rotate by contacting the pushrod by the forward movement of the firing assembly.

The guiding groove may include: a first guiding groove portion extending in a height direction; and a second guiding groove portion connected to a bottom of the first guiding groove portion and extending downward while inclined forward. The ignition device may move forward and backward with respect to the breechblock as the follower moves along the second guiding groove portion.

The cannon according to embodiments described herein may use an ignition device, which replaces a typical percussive trigger, to fire with an electrical firing signal.

The cannon according to embodiments described herein may have a reduced ignition delay time and ensure high reliability in the operation of the cannon.

The cannon according to embodiments described herein may have an electrical connection as a firing assembly moves backward or forward by a breechblock ascending or descending, thereby implementing the automated operation of the cannon.

BRIEF DESCRIPTION OF THE DRAWINGS

The above and other features of certain embodiments of the present disclosure will be more apparent from the following detailed description, taken in conjunction with the accompanying drawings, in which.

DETAILED DESCRIPTION

Figure 1:
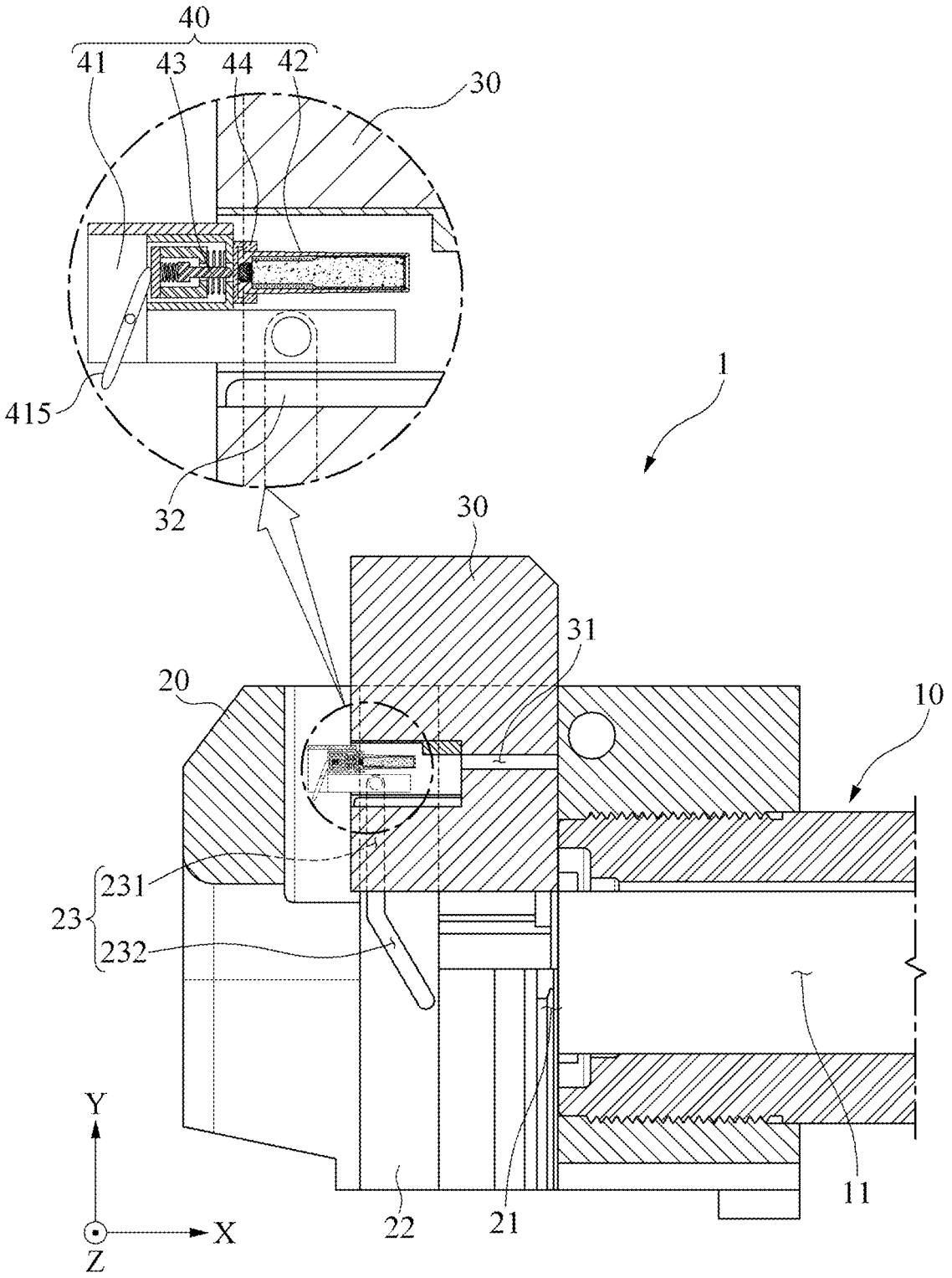
FIG. 1 is a schematic view of a cannon illustrating a state in which a breechblock is at an open position according to an embodiment.

Hereinafter, embodiments will be described in detail with reference to the accompanying drawings. However, various changes may be made to the embodiments, and the scope of claims of the present disclosure is not limited or circumscribed by these embodiments. It should be understood that any modifications, equivalents, or substitutions to the embodiments are included in the scope of the claims.

The terminology used in the embodiments is for illustrative purposes only and should not be construed as limiting. As used herein, the singular forms are intended to include the plural forms as well, unless the context clearly indicates otherwise. It should be further understood that the terms "comprise," "comprising," "include," and/or "including," when used in this disclosure, specify the presence of stated features, integers, steps, operations, elements, components, or a combination thereof, but do not preclude the presence or addition of one or more other features, integers, steps, operations, elements, components, and/or groups thereof.

Unless otherwise defined herein, all terms used herein including technical or scientific terms have the same meanings as those generally understood by one of ordinary skill in the art. Terms defined in generally used dictionaries should be construed to have meanings matching with contextual meanings in the related art and are not to be construed as an ideal or excessively formal meaning unless otherwise defined herein.

However, when describing the embodiments with reference to the accompanying drawings, identical components are given the same reference numerals regardless of the designations in the drawings, and detailed descriptions of well-known functions or configurations will be omitted for the clarity of the gist of the present disclosure.

Although terms of "first," "second," A, B, (a), and (b) are used to explain various components, the components are not limited to the terms. These terms should be used only to distinguish one component from another component, and do not define the nature, sequence, or order of the components. It is to be understood that, when a component is referred to as being "connected to" another component, the component can be directly connected or coupled to the other component, or intervening components may be present therebetween.

Also, components included in an embodiment, and components having common features, are described using the same designations in other embodiments. Unless otherwise indicated, the description of one embodiment applies to the other embodiments, and a detailed description thereof is omitted when it is deemed to be redundant.

FIG. 1 is a schematic view of a cannon 1 illustrating a state in which a breechblock is at an open position according to an embodiment.

Referring to FIG. 1, 1 according to an embodiment, the cannon may fire a shell. For example, a shell (not shown) and a propelling charge (not shown) for firing the shell may be loaded. The cannon 1 may ignite the propelling charge through an ignition device 40 and fire the shell by the pressure generated from the ignition of the propelling charge along a set trajectory. The cannon 1 may include a barrel 10, a breech ring 20, a breechblock 30, the ignition device 40, and a controller (not shown).

In an embodiment, the barrel 10 may have a chamber 11 formed therein in which the shell and the propelling charge are mounted. The barrel 10 may be formed to extend in a longitudinal direction of the chamber 11. For example, the barrel 10 may be provided in the form of a cylinder extending in the longitudinal direction (e.g., a +X direction) of the chamber 11. The chamber 11 may be open at both ends of the barrel 10. For example, at one end of the barrel 10 facing forward (e.g., the +X direction), an opening may be formed through which the shell is fired along the chamber 11. At the other end of the barrel 10 facing backward (e.g., a −X direction), the breech ring 20 may be connected. The shell may be loaded into the chamber 11 through the other open end of the barrel 10. Hereinafter, unless otherwise stated, the term "forward" or "front" may be construed as the +X direction, and the term "backward" or "rear" may be construed as the −X direction, for ease of explanation. In addition, the term "move forward" may be construed that a certain component moves in the +X direction, and the term "move backward" may be construed that a certain component moves in the −X direction.

In an embodiment, the breech ring 20 may be connected to the rear of the barrel 10. The breech ring 20 may have a shell inlet 21 formed therein to communicate with the chamber 11 into which the shell is loaded. For example, in the process of using the cannon 1, the shell and the propelling charge may be sequentially loaded into the chamber 11 through the shell inlet 21 formed in the breech ring 20. In an embodiment, the breech ring 20 may include a cam plate 22 having a guiding groove 23 formed therein. As will be described below, the guiding groove 23 may be used to move a firing assembly 41.

Figure 3A:
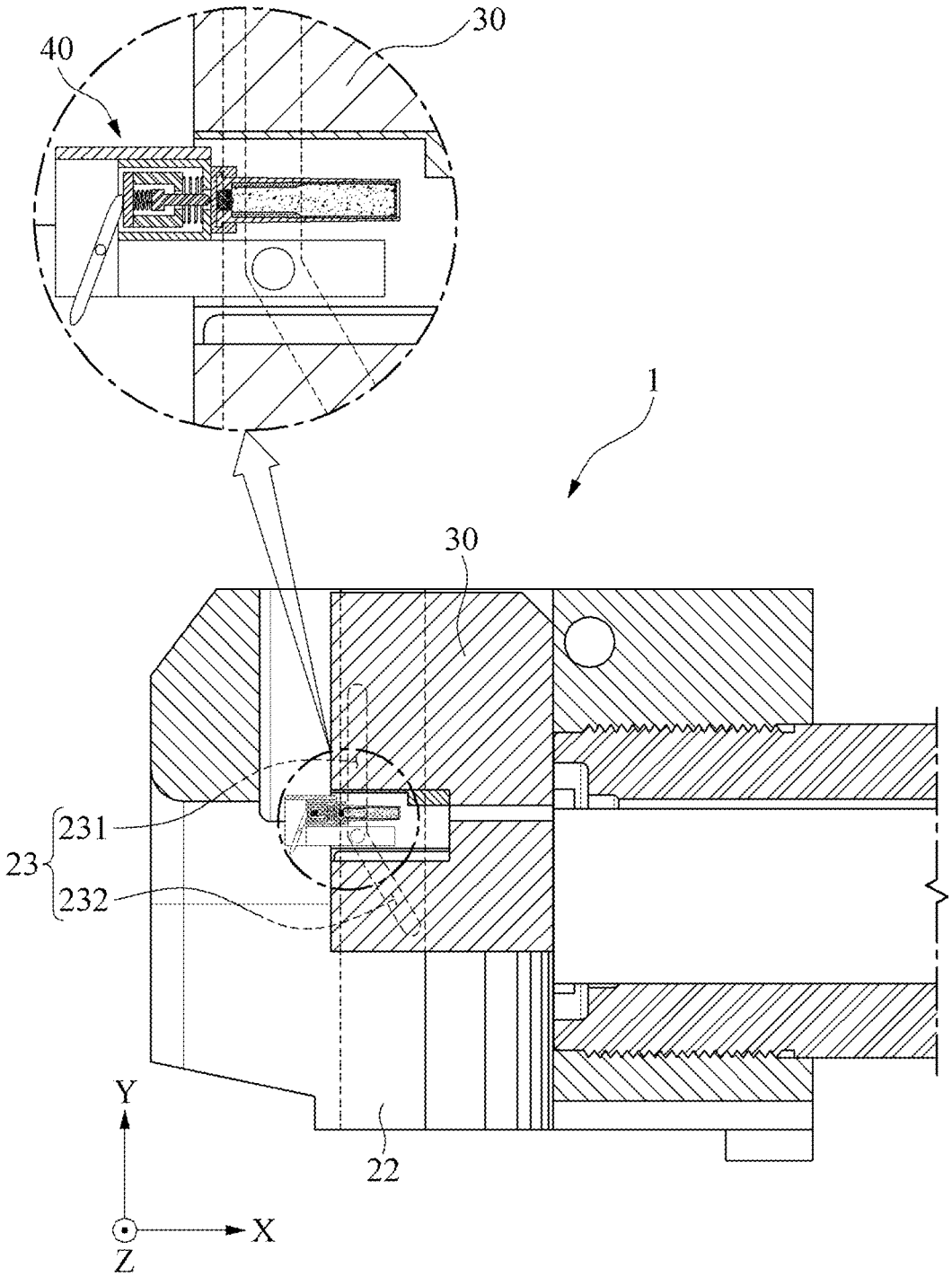
FIGS. 3A through 3D are schematic views of a cannon illustrating a process in which an ignition device moves forward with respect to a breechblock while the breechblock is descending according to an embodiment.
Figure 3B:
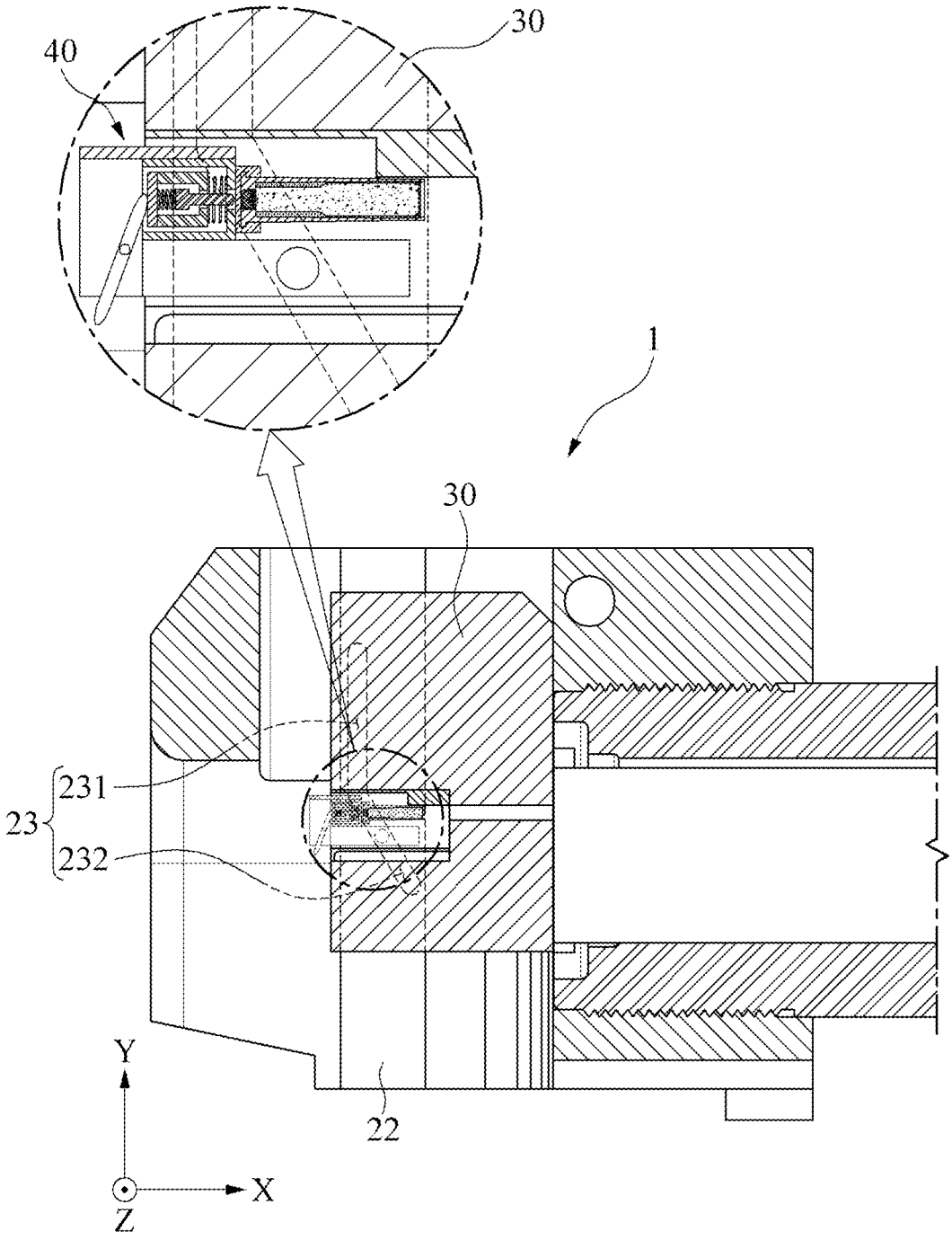
Figure 3C:
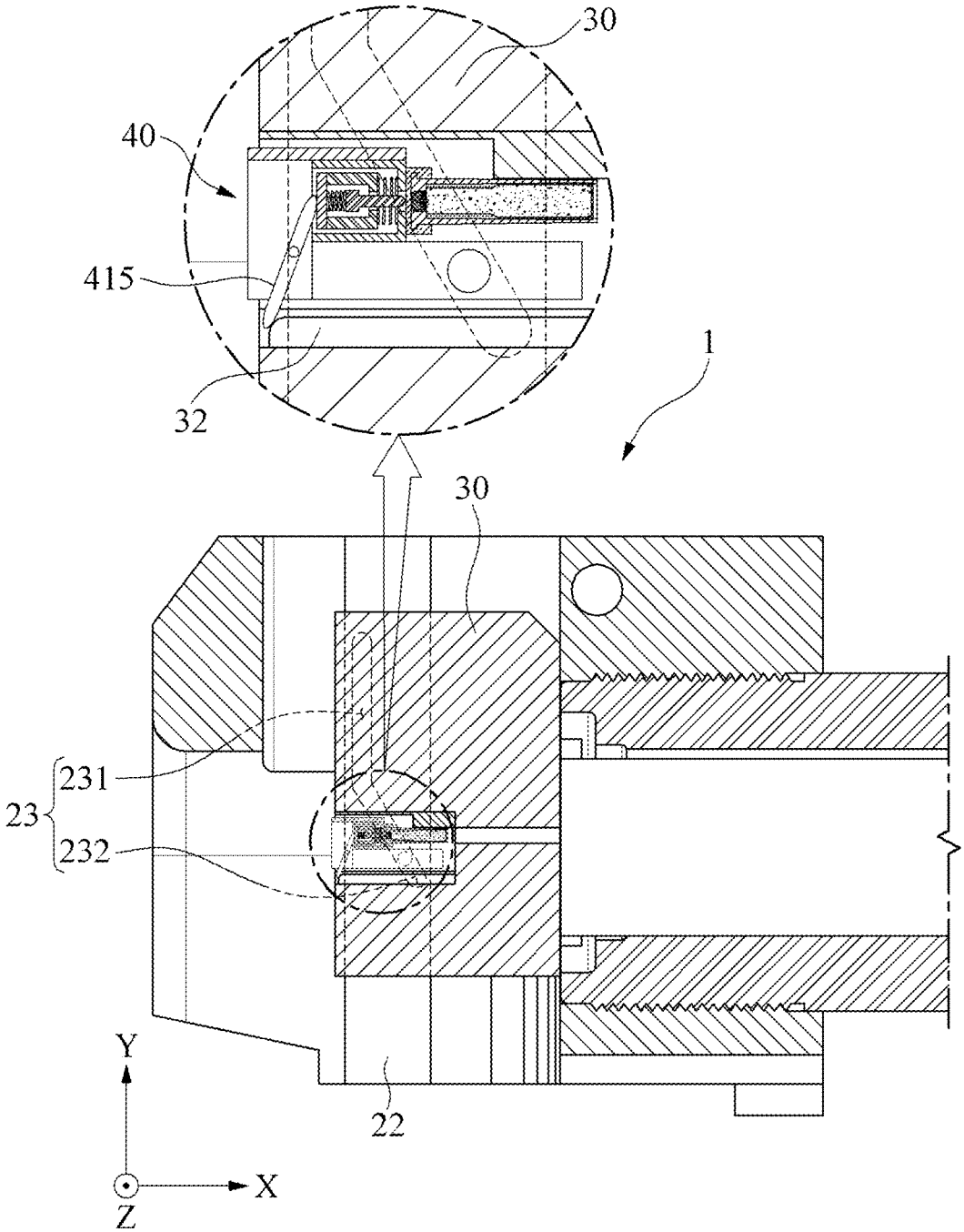
Figure 3D:
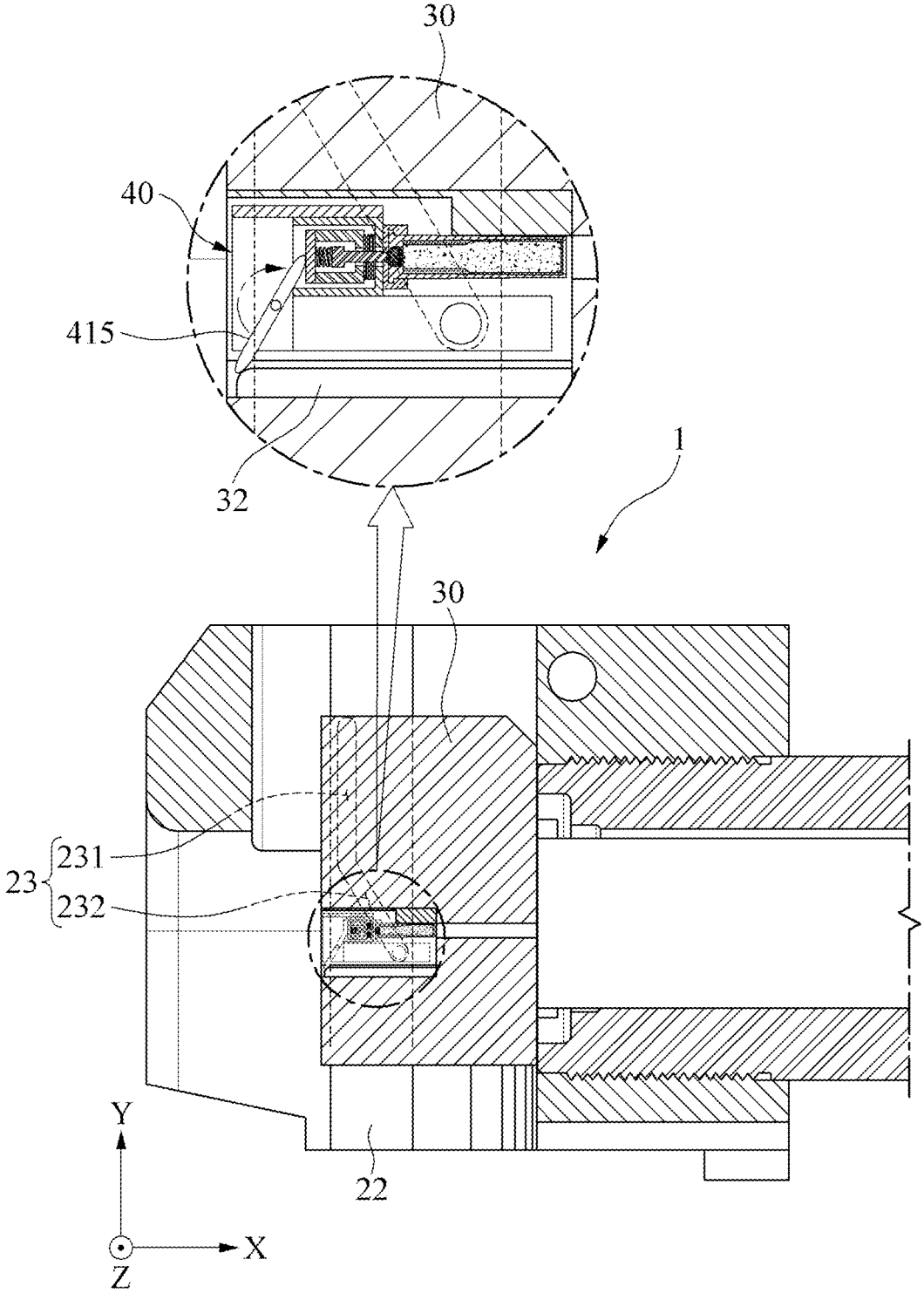

In an embodiment, the breechblock 30 may open or close the shell inlet 21. The breechblock 30 may be connected to be movable upward or downward relative to the breech ring 20. For example, the breechblock 30 may move between a closed position (refer to FIG. 3D) that closes the shell inlet 21 and an open position (refer to FIG. 1) that opens the shell inlet 21, with respect to the breech ring 20. For example, the breechblock 30 may ascend relative to the breech ring 20 to open the shell inlet 21 at the open position, and descend relative to the breech ring 20 to close the shell inlet 21 at the closed position. When the breechblock 30 is at the closed position, the breechblock 30 may close the other end of the chamber 11 facing the shell inlet 21 to prevent the pressure generated by the combustion of the propelling charge from leaking out to the rear of the barrel 10. When the breechblock 30 is at the open position, the shell and the propelling charge may be loaded into the chamber 11 through the shell inlet 21. The breechblock 30 may have a pushrod 32 formed therein that selectively comes into contact with a lever member 415 to press the lever member 415.

In an embodiment, the breechblock 30 may have a primer flame hole 31 formed therein. The primer flame hole 31 may be formed to communicate with the chamber 11 when the breechblock 30 is at the closed position. As will be described below, the rear of the primer flame hole 31 may contact the ignition device 40, and the primer flame hole 31 may transfer a flame generated by the ignition device 40 to the propelling charge mounted in the chamber 11. For example, the primer flame hole 31 may be provided in the form of a hollow cylinder to transfer the flame.

In an embodiment, the ignition device 40 may ignite the propelling charge mounted in the chamber 11. The ignition device 40 may be mounted to be partially movable relative to the breechblock 30. For example, the ignition device 40 may be configured to move backward when the breechblock 30 is at the open position and move forward when the breechblock 30 is at the closed position. The ignition device 40 may come into contact with the rear of the primer flame hole 31 by moving forward when the breechblock 30 is at the closed position. In this case, the ignition device 40 may receive an electrical firing signal to ignite the propelling charge loaded in the chamber 11 through the primer flame hole 31. The ignition device 40 may include the firing assembly 41, a laser diode primer 42, a firing pin 43, and a primer holder 44.

In an embodiment, the firing assembly 41 may move forward (e.g., in the +X direction) or backward (e.g., in the −X direction) as the breechblock 30 moves. The breechblock 30 may have a space that receives therein the firing assembly 41 which may move forward or backward together with the laser diode primer 42 and the firing pin 43 in the space as the breechblock 30 moves.

In an embodiment, the laser diode primer 42 may ignite the propelling charge. The laser diode primer 42 may be connected to the front of the firing assembly 41. For example, the laser diode primer 42 may be connected to the front of the firing assembly 41 via the primer holder 44. The laser diode primer 42 may not be in direct contact with the firing assembly 41 but may be electrically connected to the firing assembly 41 by a forward movement of the firing pin 43. For example, when the breechblock 30 is at the closed position, the front of the laser diode primer 42 may come into contact with the rear of the primer flame hole 31, and the rear of the laser diode primer 42 may come into contact with the firing pin 43 (refer to FIG. 3D). While electrically connected, the laser diode primer 42 may receive the electrical firing signal to ignite the propelling charge.

In an embodiment, the firing pin 43 may transfer the electrical firing signal received from the controller to the laser diode primer 42. The firing pin 43 may be connected to be movable forward and backward (e.g., in the X-axis direction) with respect to the firing assembly 41. For example, while the breechblock 30 is moving from the open position to the closed position, the firing pin 43 may protrude to contact the rear end of the laser diode primer 42, and may transfer the electrical firing signal to the laser diode primer 42 while in contact.

Figure 2A:
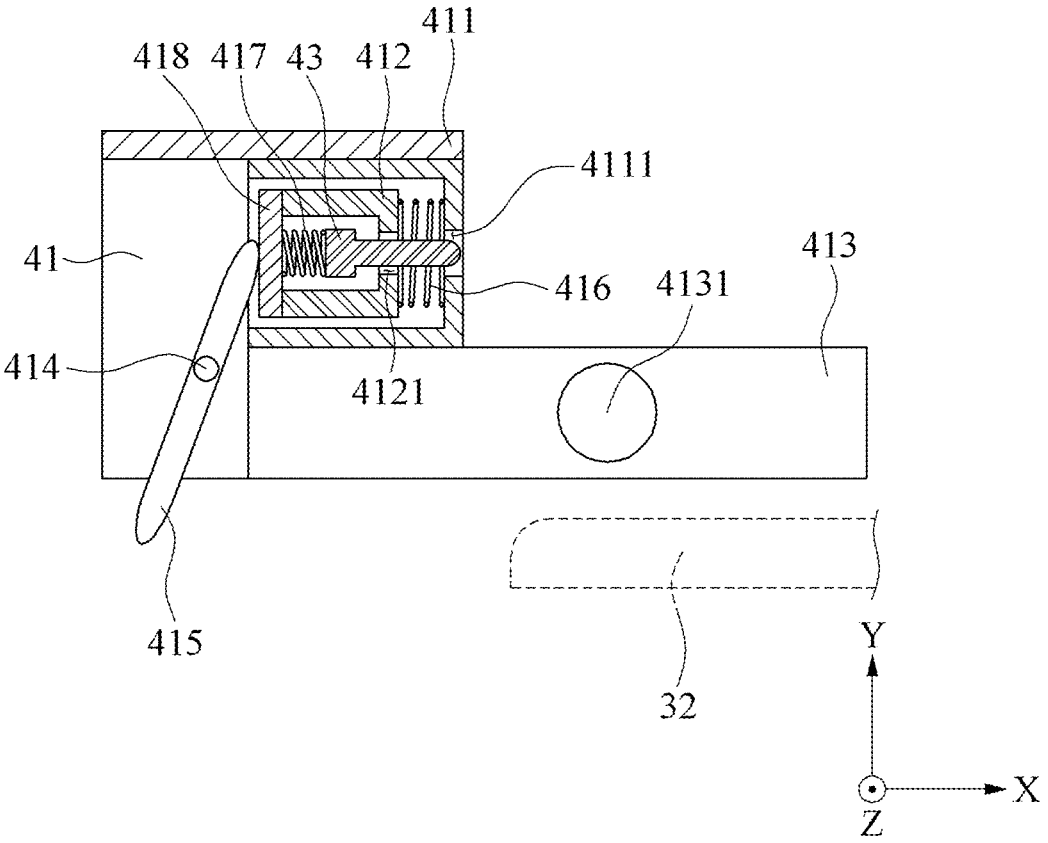
FIGS. 2A and 2B are schematic views of a cannon illustrating a process in which a second housing is pressed forward as a lever member of an ignition device comes into contact with a pushrod according to an embodiment.
Figure 2B:
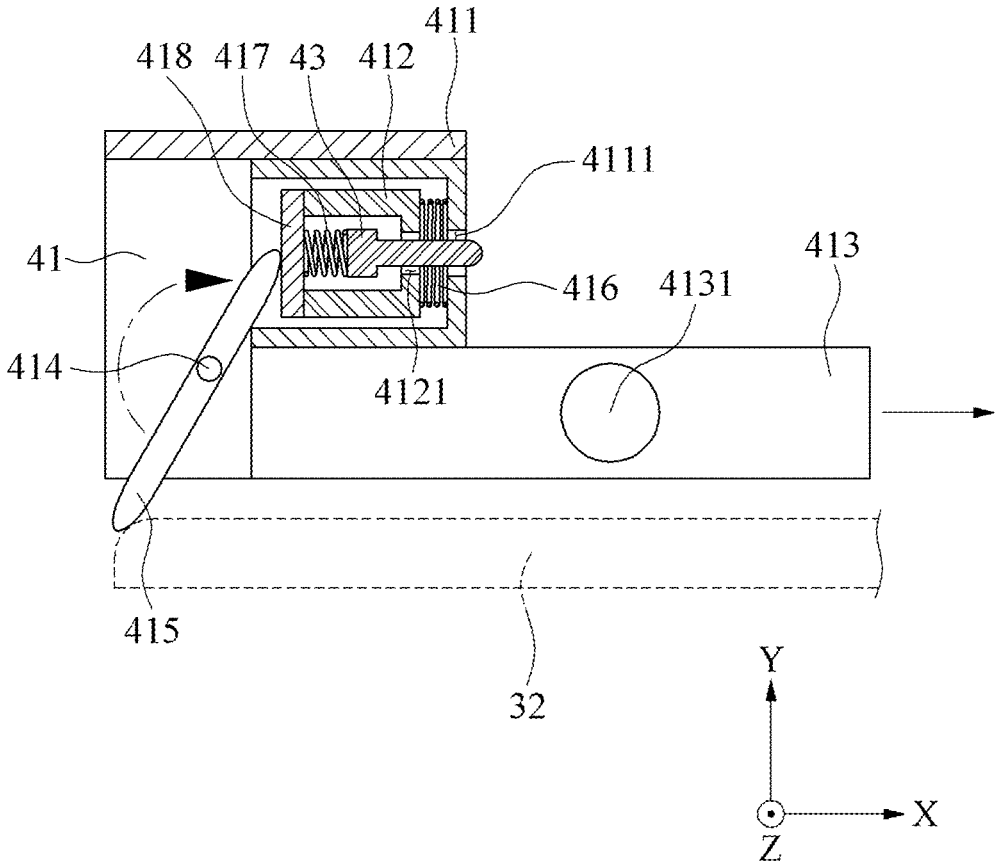

FIGS. 2A and 2B are schematic views of the cannon 1 illustrating a process in which a second housing 412 is pressed forward as the lever member 415 comes into contact with the pushrod 32 and rotates, according to an embodiment.

The operations of the firing assembly 41 and the firing pin 43 will be described below with reference to FIGS. 1, and 2A and 2B. The firing assembly 41 may include a support member 413, a first housing 411, the second housing 412, the lever member 415, a first spring 416, and a second spring 417.

In an embodiment, the support member 413 may be connected to support the first housing 411 and the second housing 412. The support member 413 may be connected to be movable forward and backward within the breechblock 30. The support member 413 may include a follower 4131 for moving forward and backward.

In an embodiment, the follower 4131 may be movably connected to the guiding groove 23 formed on the cam plate 22 of the breechblock 30. For example, the follower 4131 may move the support member 413 connected to the follower 4131 forward or backward while moving along a path of the guiding groove 23. As will be described below, even when the follower 4131 moves, the support member 413 may not move forward or backward depending on the shape of the guiding groove 23. Although the guiding groove 23 is shown as a single guiding groove in FIG. 1, it should be understood as an example only for ease of explanation, and the guiding groove 23 may be provided as a pair of guiding grooves connected to both sides of the follower 4131.

In an embodiment, the first housing 411 may be disposed on the support member 413. The first housing 411 may move forward or backward along with the support member 413 while the support member 413 is moving forward or backward. For example, the first housing 411 may include a first opening 4111 that is open forward. That is, the first opening 4111 may be formed in a direction facing the laser diode primer 42 disposed at the front of the first housing 411. For electrical insulation between the firing pin 43 present inside the first housing 411 and the breechblock 30 outside the first housing 411, the first housing 411 may be formed of an insulating material.

In an embodiment, the second housing 412 may be disposed inside the first housing 411. The second housing 412 may be disposed to be movable forward and backward within the first housing 411. For example, the second housing 412 may be configured to slide forward and backward within the first housing 411. For example, the second housing 412 may include a second opening 4121 that opens forward. Similar to the first opening 4111, the second opening 4121 may be formed in a direction facing the laser diode primer 42. The second opening 4121 may be formed to face the first opening 4111 such that the firing pin 43 may pass through the first opening 4111 and the second opening 4121 simultaneously. For electrical insulation between the firing pin 43 present inside the second housing 412 and the breechblock 30 outside the second housing 412, the second housing 412 may be formed of an insulating material.

In an embodiment, the lever member 415 may be rotatably connected to the support member 413. For example, a rotation axis 414 of the lever member 415 may be fixed to the support member 413, and an axial direction of the rotation axis 414 may be perpendicular to a movement direction of the support member 413 relative to the breechblock 30. For example, the rotation axis 414 may be parallel to a Z-axis direction.

The lever member 415 may be configured to press the second housing 412 forward through a rotation. Although one end of the lever member 415 is shown as being in contact with a rear end of the second housing 412 in FIG. 2A, there may be a gap between the one end of the lever member 415 and the rear end of the second housing 412. In this case, the lever member 415 may rotate to contact the rear end of the second housing 412, and may thereafter press the second housing 412. In this case, the other end of the lever member 415 that does not press the second housing 412 may be configured to contact the pushrod 32 by a forward movement of the support member 413. As the support member 413 continues moving forward after the lever member 415 contacts the pushrod 32, the lever member 415 may rotate, and the one end disposed opposite the other end in contact with the pushrod 32 may press the second housing 412. It is apparent to a person of ordinary skill in the art that the degree to which the lever member 415 presses the second housing 412 may be adjusted by defining a suitable length of the lever member 415.

In an embodiment, the first spring 416 may be installed in the first housing 411. The first spring 416 may be connected to apply a restoring force to the second housing 412. For example, one end of the first spring 416 may be connected to the first housing 411, and the other end of the first spring 416 may be connected to the second housing 412. The first spring 416 may restore the position of the second housing 412 relative to the first housing 411 through the restoring force. For example, when the support member 413 moves forward, the pushrod 32 formed in the support member 413 may come into contact with the lever member 415 to rotate the lever member 415. The lever member 415 may rotate to press the second housing 412 forward, and the first spring 416 may be compressed by the second housing 412. When the support member 413 moves backward, the contact between the lever member 415 and the pushrod 32 may be released, and thus an external force applied to the first spring 416 may be removed. When the external force is removed, the first spring 416 may restore the position of the second housing 412 connected to the end to its original position, e.g., backward, by the restoring force.

In an embodiment, the second spring 417 may be installed in the second housing 412. For example, one end of the second spring 417 may be connected to the rear end of the firing pin 43, and the other end of the second spring 417 may be connected to the first housing 411. The second spring 417 may be compressed when the second housing 412 is pressed forward. When no external force is applied to the second housing 412, the second spring 417 may apply a restoring force to the firing pin 43 such that at least a portion of the firing pin 43 is positioned on the first opening 4111. For example, when the lever member 415 is not in contact with the pushrod 32, the lever member 415 may not press the second housing 412, and the second spring 417 may allow at least a portion of the front of the firing pin 43 to be positioned on the first opening 4111. As the lever member 415 presses the second housing 412 forward, the second housing 412, the second spring 417, and the firing pin 43 may move forward, and the front of the firing pin 43 that has passed through the first opening 4111 may contact the rear end of the laser diode primer 42. When the support member 413 continues moving forward after the front of the firing pin 43 contacts the rear end of the laser diode primer 42, the second spring 417 may be compressed. That is, the second spring 417 may allow the lever member 415 to press the second housing 412 forward beyond a gap between the front end of the firing pin 43 and the rear end of the laser diode primer 42.

In an embodiment, the firing pin 43 may be installed inside the second housing 412 such that it may pass through the first opening 4111. The front end of the firing pin 43 may protrude forward when the second housing 412 is pressed forward. For example, when the second housing 412 is pressed forward, the front end of the firing pin 43 may protrude forward through the second opening 4121 of the second housing 412 and the first opening 4111 of the first housing 411. In this case, the firing pin 43 may protrude forward to contact the rear end of the laser diode primer 42, and may transfer an electrical firing signal to the laser diode primer 42 while in contact. In an embodiment, the firing pin 43 may be configured to contact the rear end of the laser diode primer 42 by a rotation of the lever member 415. For example, while the breechblock 30 is moving from the open position to the closed position, the lever member 415 may rotate to press the second housing 412 forward, and when the second housing 412 is pressed forward, the firing pin 43 may protrude forward to contact the rear end of the laser diode primer 42.

In an embodiment, the controller (not shown) may generate the electrical firing signal. The breech ring 20, the breechblock 30, and the second housing 412 may each have an electrical contact portion formed to receive such an electrical signal. The electrical firing signal generated by the controller may be applied to the ignition device 40 via an electrical contact portion (not shown) formed in the ignition device 40. The electrical contact portion may provide an electrical connection between the respective corresponding components as the barrel 10 recoils and/or returns and the breechblock 30 is opened and/or closed. For example, when the barrel 10 returns and the breechblock 30 is closed, the controller, an electrical contact portion formed in the breech ring 20, an electrical contact portion formed in the breechblock 30, and an electrical contact portion 418 formed in the second housing 412 may contact each other to be electrically connected. The second spring 417 and the firing pin 43 may be formed of an electrically conductive material to transfer the electrical firing signal. For example, when the barrel 10 returns and the breechblock 30 is closed, the firing pin 43 may protrude to contact the rear end of the rear end of the laser diode primer 42, and thus the controller, the electrical contact portion 418, the second spring 417, the firing pin 43, and the laser diode primer 42 may be electrically connected. Therefore, the electrical firing signal generated by the controller may be transferred to the laser diode primer 42.

FIGS. 3A through 3D are schematic views of the cannon 1 illustrating a process in which the ignition device 40 moves forward with respect to the breechblock 30 while the breechblock 30 is descending, according to an embodiment.

The process in which the firing assembly 41 moves forward while the breechblock 30 is descending will be described below with reference to FIGS. 1 and 3A through 3D.

In an embodiment, the breech ring 20 may include the cam plate 22 on which the guiding groove 23 is formed. While the breechblock 30 is descending, the follower 4131 may move along the guiding groove 23 formed on the cam plate 22 of the breechblock 30. The cam plate 22 may be used for typical primer percussion-type ignition. While the follower 4131 is moving along the path of the guiding groove 23, the support member 413 connected to the follower 4131 may move forward or backward. In an embodiment, the guiding groove 23 may include a first guiding groove portion 231 and a second guiding groove portion 232. The first guiding groove portion 231 may extend in a height direction (e.g., a +Y direction). The second guiding groove portion 232 may be connected to a bottom of the first guiding groove portion 231 and may extend by being inclined forward. Although the guiding groove 23 is shown as having the first guiding groove portion 231 and the second guiding groove portion 232 in FIGS. 1 and 3A through 3D, it is apparent to a person of ordinary skill in the art that the structure of the guiding groove 23 may be changed suitably to move the ignition device 40 forward. For example, the guiding groove 23 may include a curved guiding groove portion to allow the ignition device 40 to move forward.

When the breechblock 30 is at the open position (refer to FIG. 1), the shell and the propelling charge may be sequentially loaded into the chamber 11. When the shell and the propelling charge are loaded, the breechblock 30 may start descending. While the follower 4131 is moving along the first guiding groove portion 231, the ignition device 40 may not move forward (refer to FIG. 3A). While the follower 4131 is moving along the second guiding groove portion 232, the ignition device 40 may move forward (refer to FIG. 3B). While the follower 4131 is moving along the second guiding groove portion 232, the ignition device 40 may move forward, and the lever member 415 may contact the pushrod 32 (refer to FIG. 3C). While the follower 4131 is moving along the second guiding groove portion 232, the lever member 415 may rotate by the pushrod 32, and the firing pin 43 may protrude forward (refer to FIG. 3D).

As the firing pin 43 protrudes and comes into contact with the laser diode primer 42, an electrical firing signal may be transferred and, after the shell is fired, the breechblock 30 may be opened. While the breechblock 30 is opening, the ignition device 40 may move backward by a movement of the follower 4131, and the contact between the firing pin 43 and the laser diode primer 42 may be released.

Figure 4A:
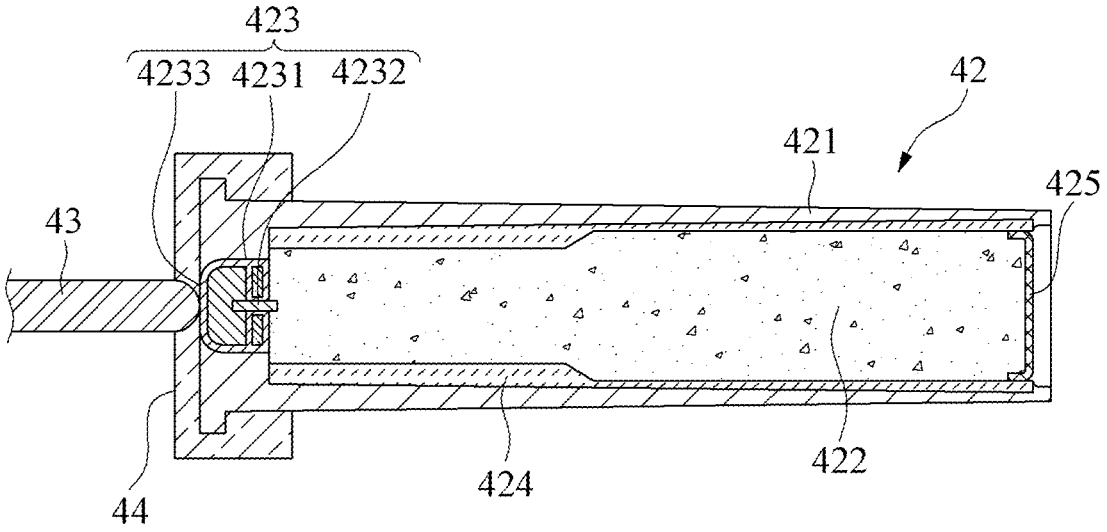
FIGS. 4A and 4B are schematic views of a cannon illustrating a laser diode primer that ignites gunpowder with a laser diode according to an embodiment.
Figure 4B:
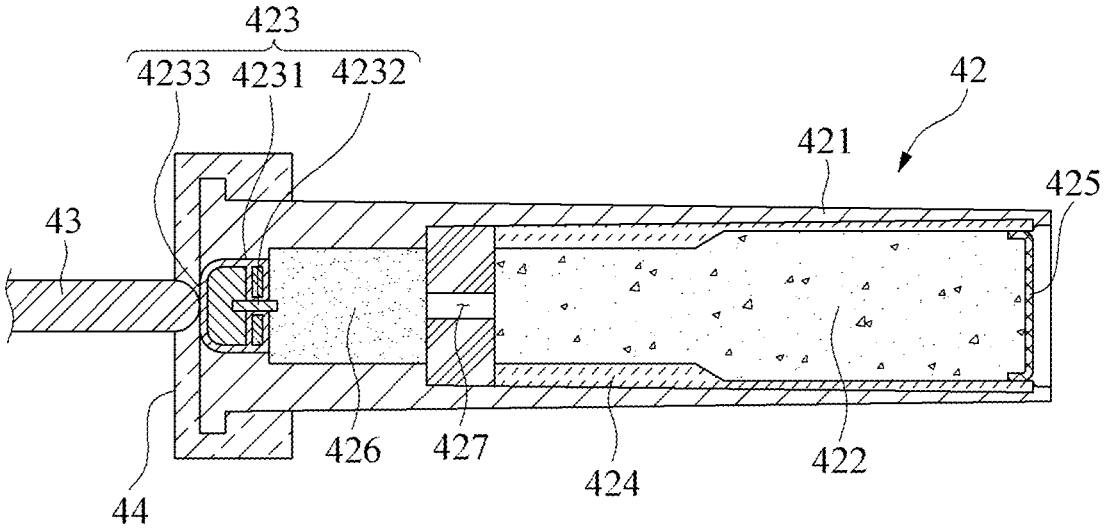

FIGS. 4A and 4B are schematic views of the cannon 1 illustrating the laser diode primer 42 that ignites gunpowder 422 with a laser diode 4232, according to an embodiment.

Referring to FIG. 4A, the laser diode primer 42 may receive an electrical firing signal from the firing pin 43. The laser diode primer 42 may be mounted on the primer holder 44 and may move forward or backward along with the firing assembly 41. That is, a gap between the laser diode primer 42 and the firing assembly 41 may be maintained constant, and an electrical connection may be applied or released by a forward or backward movement of the firing pin 43. The laser diode primer 42 may include a case 421, the gunpowder 422, and a primer cup 423.

In an embodiment, the gunpowder 422 and the primer cup 423 may be disposed inside the case 421. A space may be formed inside the case 421, in which the gunpowder 422 and the primer cup 423 are disposed. For example, the case 421 may be provided in the form of a hollow cylinder.

In an embodiment, the gunpowder 422 may be disposed inside a container 424 and may generate a flame. A space may be formed in the container 424, in which the gunpowder 422 is disposed. For example, the container 424 may be provided in the form of a hollow cylinder. One end of the container 424 that faces forward may be closed by a container cup 425, and the other end of the container 424 that faces backward may contact the primer cup 423. When the gunpowder 422 is ignited by the primer cup 423, a flame may be generated, and the generated flame may be transferred toward the front of the cannon 1. The generated flame may remove the container cup 425, and the generated flame may be transferred through the primer flame hole 31 to the propelling charge disposed in the chamber 11. For example, the container 424 may be formed of a material that endures the pressure generated by the gunpowder 422, and may have an internal structure formed to transfer the generated flame forward.

In an embodiment, the primer cup 423 may be configured to ignite the gunpowder 422. The primer cup 423 may be disposed inside the case 421 to emit a laser beam toward the gunpowder 422 when activated. For example, the primer cup 423 may be disposed at the rear end of the container 424 in which the gunpowder 422 is disposed. The primer cup 423 may also be disposed to be electrically connected to the firing pin 43 inside the case 421. That is, it may be disposed to release the contact with the firing pin 43 when the firing pin 43 moves backward, and disposed to contact the firing pin 43 when the firing pin 43 moves forward. The primer cup 423 may include a cup 4231 and the laser diode 4232.

In an embodiment, the laser diode 4232 may be disposed inside the cup 4231. At one end of the cup 4231, a firing pin contact portion 4233 that may selectively contact the firing pin 43 may be formed. The firing pin contact portion 4233 may be formed of an electrically conductive material. For example, as the firing pin 43 moves forward, the front end of the firing pin 43 may come into contact with the firing pin contact portion 4233 formed at the one end of the cup 4231, and an electrical firing signal may be transferred from the firing pin 43 to the firing pin contact portion 4233.

In an embodiment, the laser diode 4232 may emit (or oscillate) a laser toward the gunpowder 422. For example, the laser diode 4232 may be activated when the firing pin contact portion 4233 receives the electrical firing signal. The laser diode 4232 may be fixed inside the cup 4231 through molding to emit the laser toward the gunpowder 422.

Referring to FIG. 4B, the laser diode primer 42 may include the case 421, the gunpowder 422, the primer cup 423, a primer ignition material 426, and a through-hole 427. In an embodiment, the primer ignition material 426 may be used to ignite the gunpowder 422. When receiving the laser emitted by the laser diode 4232, the primer ignition material 426 may be ignited, generating a flame. For example, the primer ignition material 426 may be used when an output power of the laser is not sufficient to ignite the gunpowder 422. Although not shown in FIG. 4B, the primer ignition material 426 may be disposed inside a separate container 424.

In an embodiment, the through-hole 427 may be formed to penetrate between the primer ignition material 426 and the gunpowder 422. Thus, when the laser generated by the laser diode 4232 ignites the primer ignition material 426, the generated flame may be transferred to the gunpowder 422 through the through-hole 427, and a flamed may be generated again to be transferred to the propelling charge through the primer flame hole 31. The through-hole 427 may be formed of a material that endures the pressure generated by the ignition of the primer ignition material 426. Although, the through-hole 427 is shown as separate from the container 424 in FIG. 4B, it may be formed at the rear end of the container 424 to be integral with the container 424

While this disclosure includes specific examples, it will be apparent after an understanding of the disclosure of this application that various changes in form and details may be made in these examples without departing from the spirit and scope of the claims and their equivalents. The embodiments described herein are to be considered in a descriptive sense only, and not for purposes of limitation. Descriptions of features or aspects in each embodiment are to be considered as being applicable to similar features or aspects in other embodiment. Suitable results may be achieved if the described techniques are performed in a different order, and/or if components in a described system, architecture, device, or circuit are combined in a different manner, and/or replaced or supplemented by other components or their equivalents.

Therefore, in addition to the above disclosure, the scope of the disclosure may also be defined by the claims and their equivalents, and all variations within the scope of the claims and their equivalents are to be construed as being included in the disclosure.

What is claimed is:

1. A cannon, comprising:

a barrel having a chamber formed therein in which a shell and a propelling charge are mounted;

a breech ring connected to the rear of the barrel, and having a shell inlet communicating with the chamber;

a breechblock connected to the breech ring to be movable upward and downward with respect to the breech ring between a closed position that closes the shell inlet and an open position that opens the shell inlet, and having a primer flame hole communicating with the chamber at the closed position;

an ignition device mounted to be partially movable with respect to the breechblock and configured to ignite the propelling charge mounted in the chamber through the primer flame hole; and a controller configured to transfer an electrical firing signal to the ignition device, wherein the ignition device comprises:

a firing assembly configured to move forward and backward as the breechblock moves;

a laser diode primer comprising a case and gunpowder disposed inside the case, connected to the front of the firing assembly and contacting the rear of the primer flame hole at the closed position, and configured to receive the electrical firing signal to ignite the propelling charge through the primer flame hole; and a firing pin connected to the firing assembly to be movable forward and backward with respect to the firing assembly and configured to transfer the electrical firing signal to the laser diode primer while in contact with a rear end of the laser diode primer.

2. The cannon of claim 1, wherein the firing assembly comprises:

a support member;

a first housing disposed on the support member and comprising a first opening that is open forward;

a second housing disposed within the first housing, movable forward and backward inside the first housing, and comprising a second opening that is open forward; and a lever member configured to press the second housing forward through a rotation, wherein the firing pin is installed in the second housing such that a front end thereof passes through the first opening.

3. The cannon of claim 2, wherein the firing assembly further comprises:

a first spring installed in the first housing and configured to restore a position of the second housing.

4. The cannon of claim 3, wherein the firing pin is positioned inside the first housing when no external force is applied, and the front end protrudes to the front of the first housing when the second housing is pressed forward by the lever member.

5. The cannon of claim 4, wherein the firing pin comes into contact with the rear end of the laser diode primer by a rotation of the lever member when the breechblock is at the closed position.

6. The cannon of claim 5, wherein the firing assembly further comprises:

a second spring installed in the second housing and connected to a rear end of the firing pin, wherein the second spring is compressed when the second housing is pressed forward, and applies a restoring force to the firing pin such that at least a portion of the firing pin is positioned on the first opening when no external force is applied to the second housing.

7. The cannon of claim 2, wherein the breech ring further comprises:

a cam plate having a guiding groove formed therein, wherein the support member further comprises a follower movably connected to the guiding groove, and the breechblock further comprises a pushrod selectively contacting the lever member, wherein, while the breechblock is moving from the open position to the closed position, the firing assembly moves forward by a movement of the follower, and the lever member rotates by contacting the pushrod by the forward movement of the firing assembly.

8. The cannon of claim 7, wherein the guiding groove comprises:

a first guiding groove portion extending in a height direction; and a second guiding groove portion connected to a bottom of the first guiding groove portion and extending downward while inclined forward, wherein the ignition device moves forward and backward with respect to the breechblock as the follower moves along the second guiding groove portion.

* * * * *